US008217248B1

(12) United States Patent
Feliciano

(10) Patent No.: US 8,217,248 B1
(45) Date of Patent: Jul. 10, 2012

(54) LIGATURE

(76) Inventor: Roberto Feliciano, Bayamon, PR (US)

( * ) Notice: Subject to any disclaimer, the term of this patent is extended or adjusted under 35 U.S.C. 154(b) by 0 days.

(21) Appl. No.: 12/985,391

(22) Filed: Jan. 6, 2011

Related U.S. Application Data

(60) Provisional application No. 61/293,498, filed on Jan. 8, 2010.

(51) Int. Cl.
*G10D 9/02* (2006.01)

(52) U.S. Cl. ..... 84/383 R; 84/380 R; 84/382

(58) Field of Classification Search ..... 84/383 R
See application file for complete search history.

(56) References Cited

U.S. PATENT DOCUMENTS

| | | | | |
|---|---|---|---|---|
| 4,669,352 | A * | 6/1987 | Bichon | 84/383 R |
| 6,670,534 | B2 * | 12/2003 | Vildosola Erdociain | 84/383 R |
| 2004/0177743 | A1 * | 9/2004 | Jo | 84/380 R |

* cited by examiner

*Primary Examiner* — Elvin G Enad
*Assistant Examiner* — Christopher Uhlir
(74) *Attorney, Agent, or Firm* — Luis Figarella

(57) ABSTRACT

A musical instrument ligature having at least one compression bed which act as the contact points between the ligature and the reed on the mouthpiece of a wind instrument. Said ligature is significantly juxtaposed to an opposite spar and support elements, positioned so as to optimize the fixation of the reed to the mouthpiece.

1 Claim, 8 Drawing Sheets

LIGATURE

CROSS-REFERENCE TO RELATED APPLICATIONS

This application claims priority to co-pending U.S. provisional patent application Ser. No. 61/293,498 titled "Ligature" filed on Jan. 8, 2010, the disclosure of which is herein incorporated by reference in its entirety.

PATENTS CITED

The following documents and references are incorporated by reference in their entirety, Wanne (U.S. Pat. No. 7,737,350), Vildosola (U.S. Pat. No. 6,670,534), Petit (U.S. Pat. No. 4,991,483), Valtchev (U.S. Pat. No. 5,440,962), Johnson (U.S. Pat. No. 4,941,385).

FIELD OF THE INVENTION

The present invention generally relates to musical instruments, and more particularly to those wherein a reed or other vibrating member must be held securely to a mouthpiece.

DESCRIPTION OF THE RELATED ART

Traditional woodwind instruments consist of a tubular body used to define a column of air. Sound waves are produced within the column of air and the musical characteristics of the sounds, including pitch, volume and other characteristics are modulated by changing the acoustic characteristics of the column. A mouthpiece is attached to an end of the tubular body. The mouthpiece has a cavity in communication with the interior of the tubular body. A reed covers the cavity and is arranged so that when a musician blows through the mouthpiece, the reed oscillates and produces vibrations which are then propagated through the cavity in the mouthpiece to the tubular body.

The reed is secured to the mouthpiece by an adjustable mechanism known as a ligature. In most cases, the ligature is a metal band that normally extends circumferentially around the entire outer body of the mouthpiece. Traditional ligatures are provided with an integral tightening mechanism that is used to secure the reed to the mouthpiece. Because of the mechanical coupling between the ligature, the mouthpiece and the reed, the structure of the ligature plays a role in the sound produced by the instruments, and various types of ligatures are available from different companies, each having its own sound characteristics. FIG. 1 shows some known prior art mouthpieces and ligatures for saxophones.

SUMMARY OF THE INVENTION

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

In one aspect, the present invention pertains to a ligature for selectively attaching a reed to the mouthpiece of a wind instrument, said ligature comprising a circumferential assembly formed by the flexible attachment of a bridge to both ends of a body, a compression pad, designed to press said reed against said mouthpiece, a mechanism for applying pressure on said compression pad; and a spar with wing elements located significantly diametrically opposite said compression pad, said wing elements designed to make contact with the mouthpiece, and having an area significantly similar to that of the compression pad. In another aspect, the compression means are comprised of a screw travelling through a threaded opening on said bridge.

In another aspect, dampening means are placed at the contact points of said ligature with both the reed and the mouthpiece. Said dampening means may be comprised of brass, plastic, cork, leather (natural or synthetic), vinyl or other suitable isolating materials attached to the compression pad through chemical, mechanical, hoops and loops or other methods. In another aspect, a dampening assembly comprised of dampening material and magnetic materials may be used to secure said assembly to the compression pad.

In another aspect, the invention pertains to an improved ligature capable of placing the reed in a secure mechanical relationship to the mouthpiece, amplifying desired vibrations and reducing unwanted vibrations, and being capable of keeping the reed/mouthpiece position relationship as desired (by the user when the instruments is "tuned"), throughout usage by the musician. This usage includes storage, assembly of the mouthpiece to the instrument and repeated handling during a performance.

In one aspect of the invention, the proposed ligature includes a ligature body of adjustable effective length passing around the mouthpiece. The length of the band is set to conform to a dimension of the mouthpiece. In another aspect of the invention, instrument includes a tightening mechanism to tighten the band. The tightening mechanism may include a thumbscrew that is selectively advanced toward the instrument body and a plate attached to said thumbscrew and forming an interference fit with said instrument body. A magnetic base may be used to secure the tightening mechanism to the portion of the ligature assembly pressing on the reed.

The present invention further pertains to a ligature for selectively attaching a reed to one of several musical instrument mouthpieces, each instrument having respective instrument bodies with a ligature receiving zone dimension. Each being constructed and arranged to attach the reed to said mouthpiece body. Preferably, the ligature body has an elongated shape with first and second opposed body ends. The first end is attached to the reed holding end, and the other end is attached to the stabilization end.

Other features and advantages of the present invention will become apparent upon examining the following detailed description of an embodiment thereof, taken in conjunction with the attached drawings.

DETAILED DESCRIPTION OF THE PREFERRED EMBODIMENT

To provide an overall understanding of the invention, certain illustrative embodiments will now be described, including apparatus and methods for displaying images. However, it will be understood by one of ordinary skill in the art that the systems and methods described herein may be adapted and modified as is appropriate for the application being addressed and that the systems and methods described herein may be employed in other suitable applications, and that such other additions and modifications will not depart from the scope hereof.

Figure 1:
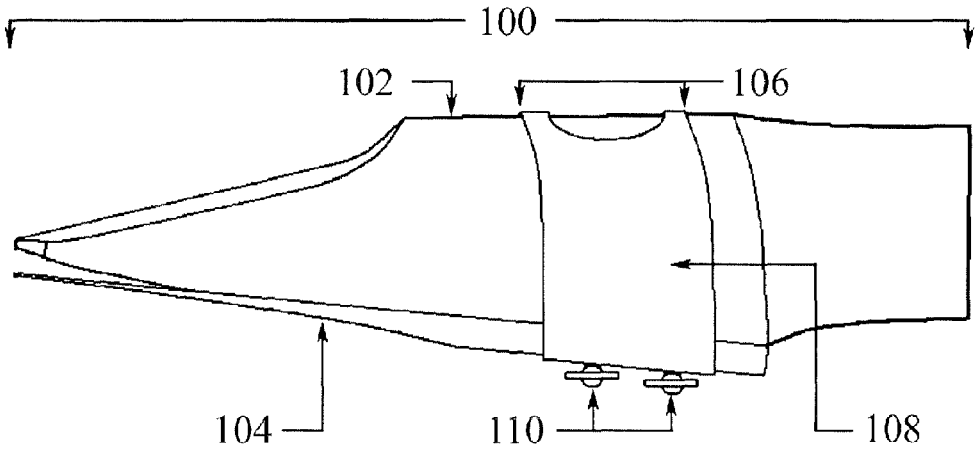
Figure 1 Prior Art
FIG. 1 shows a side view of a mouthpiece with a prior art ligature.

In order to provide a better understanding of the invention, some prior art ligatures are first discussed. Referring first to FIG. 1, a typical setup 100 is shown, it contains a mouthpiece 102 is shown with an installed reed 104. The reed 104 is attached or secured to the mouthpiece 102 with a prior art ligature 106. Such a ligature 106, typically has a band 108 disposed around the mouthpiece 102. The band 108 is tightened with two screws 110 which provide the pressure around the mouthpiece 102 that holds the reed 104 in place. Typically, prior ligatures have a fixed band length, and as such only fit one size of mouthpiece.

Figure 2:
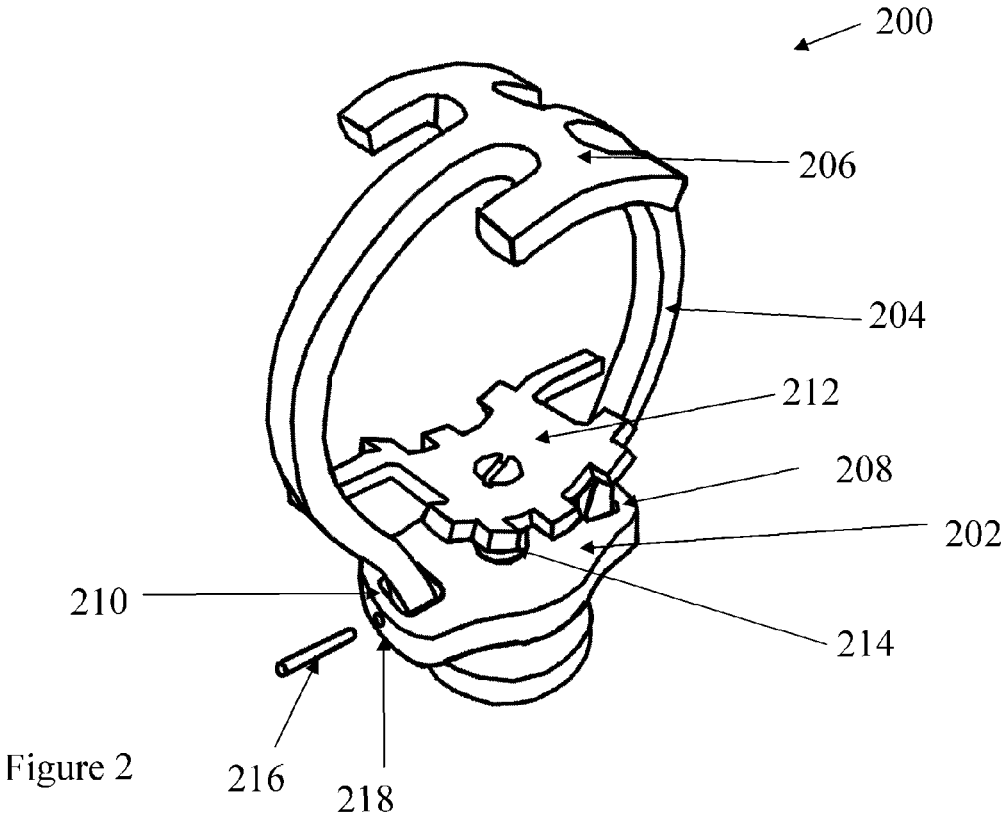
FIGS. 2 and 3 show illustrations of isometric views of exemplary embodiments of the invention.
Figure 3:
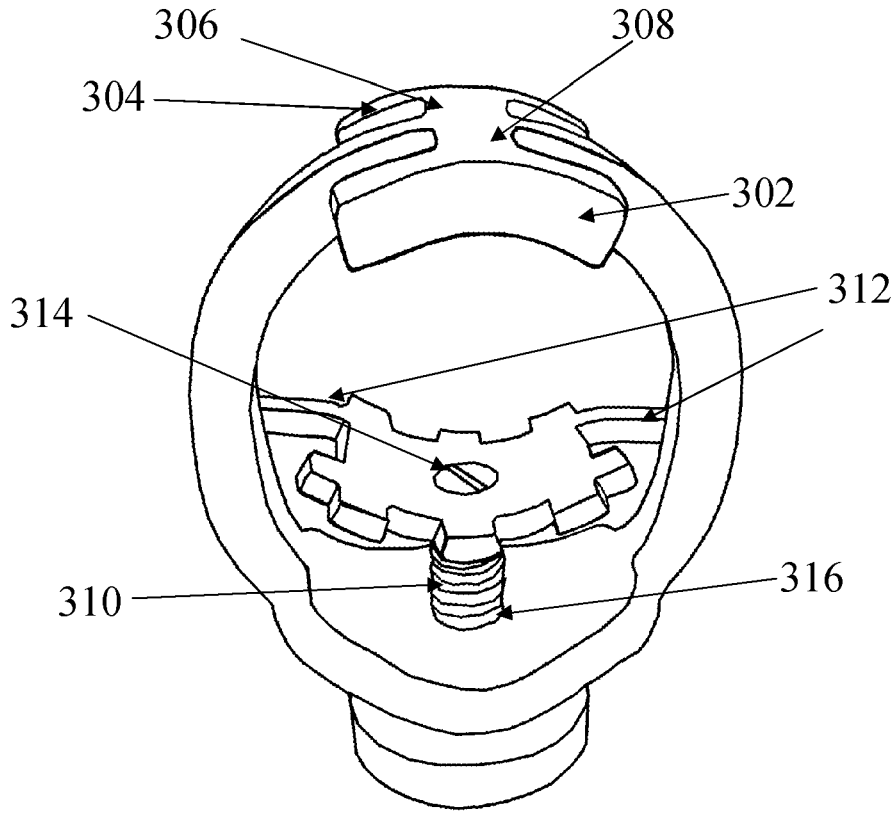

One embodiment of the invention can be seen in FIGS. 2 and 3, representing isometric views an exemplary embodiment of the ligature system 200. A bridge 202 serves to securely, yet flexibly and permanently attach both ends (208, 210) of the ligature body 204. In one embodiment this bridge and body are made up of brass or another suitable metal, although combinations of other materials may be used to manufacture it, including wood, plastic, carbon composites and others.

The overall diameter of the ligature is defined by the length of the body 204. In one embodiment, one or both sides of the body 204 may be equipped with turnbuckle screws and screw ends, so that by turning them, the overall length of the circumference is shortened.

Various other combinations of bridge 202 and body 204 may be required to fit different sized diameter mouthpieces. A compression mechanism 214 (e.g. an acme screw, screw, thumbscrew) or other compression mechanism (e.g. ratchet, nut, bolt) is used to provide pressure from the bridge towards the center of the ring created by the circumference of the bridge 202 and body 204.

Figure 9:
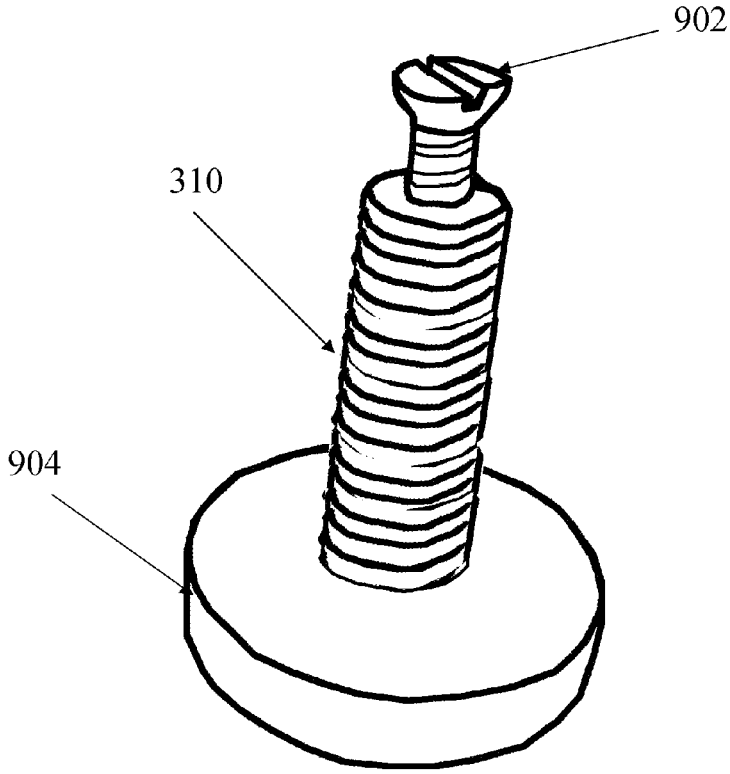

In one embodiment FIG. 9, such a compression mechanism 900 can be a screw 310, having a knob 904 and a top 902 to rotate it. The contact point 314 between the screw 310 and the bed or pad 212, is created by a free rotating joint formed by an opening in the pad 212 that captures the top of the screw 902, but allows for its free rotation in order to minimize the desire to rotate as part of the pressure. The pressure on the reed is accomplished by a screw 310 connection the compression means and the bed. Said compression is accomplished because the screw 310 advances through a complementary thread in the bridge opening 316 in the bridge 202. In an alternate embodiments, the top 902 consists of a magnetic material of opposite polarity to the bed 212, allowing a magnetic coupling between the two, and easy replacement by the user.

Rotating the compression means, forces the screw to advance on the thread created within the bridge opening 316, advancing the movable compression pad or bed 212 into the inner portion of the ring, creating a force upon the side of the reed in contact with the bed 212, or whatever material is placed over the pad 212. This pressure provides a downward force on the pad 212 which in turn pressures the reed against the desired position in the mouthpiece, keeping it in place.

The bed 212 is of dimensions significantly proportional to those of the spar 206 and its wing support elements 302, 304, in effect providing an I-beam in three dimensions, without the significant expense of material seen in previous solutions. By creating a spar 206, instead of a cantilever (as Vildosola, U.S. Pat. No. 6,670,534) The present invention reduces significantly the built in resonant vibration (the reason spring boards are held only on one side and not in the middle).

As seen in the prior art, most mouthpieces are conical in shape, tapering to the narrow spot where they reed/mouthpiece vibration occurs when the operator lips make contact. The connection between the bridge 202 and the body 204 must be secure, yet flexible enough to adjust for the tapering of the mouthpiece along its length. In one embodiment, this is accomplished by the use of a dowel pin 216 or other such rod which penetrates and opening 218 in one bridge end and a respective opening in the body end 210 securely attaching the body 204 to the bridge 202. A similar arrangement is repeated at the other body end 208. Said pinning securely attaches the body ends (208, 210) while at the same time allowing a degree of rotation or play that allows for the bridge to remain significantly parallel to the surface of the mouthpiece, regardless of its slope. In effect, this makes the pressure on the reed significantly parallel to the surface of the mouthpiece, which is optimal.

In one embodiment, the tendency of the bed 212 to rotate when tightened is reduced by providing it with two or more whiskers or outlying wings 312 that overlap the outer dimension of the ring created by the body 204. In this way, any tendency to rotate in either direction is cancelled by the overlap whisker 312 hitting the ring body.

In addition to the rotational movement, there is an additional freedom of movement by the bed 212 through its pivot point (as well as through the compression of whatever material is used to provide pressure on the reed), that makes the angle of pressure by the mechanism on the reed significantly parallel to the surface of the mouthpiece along the length of the reed. This results in an optimal holding position, as far as the vibrations (and sound thus generated by the instrument) goes.

Figure 4A:
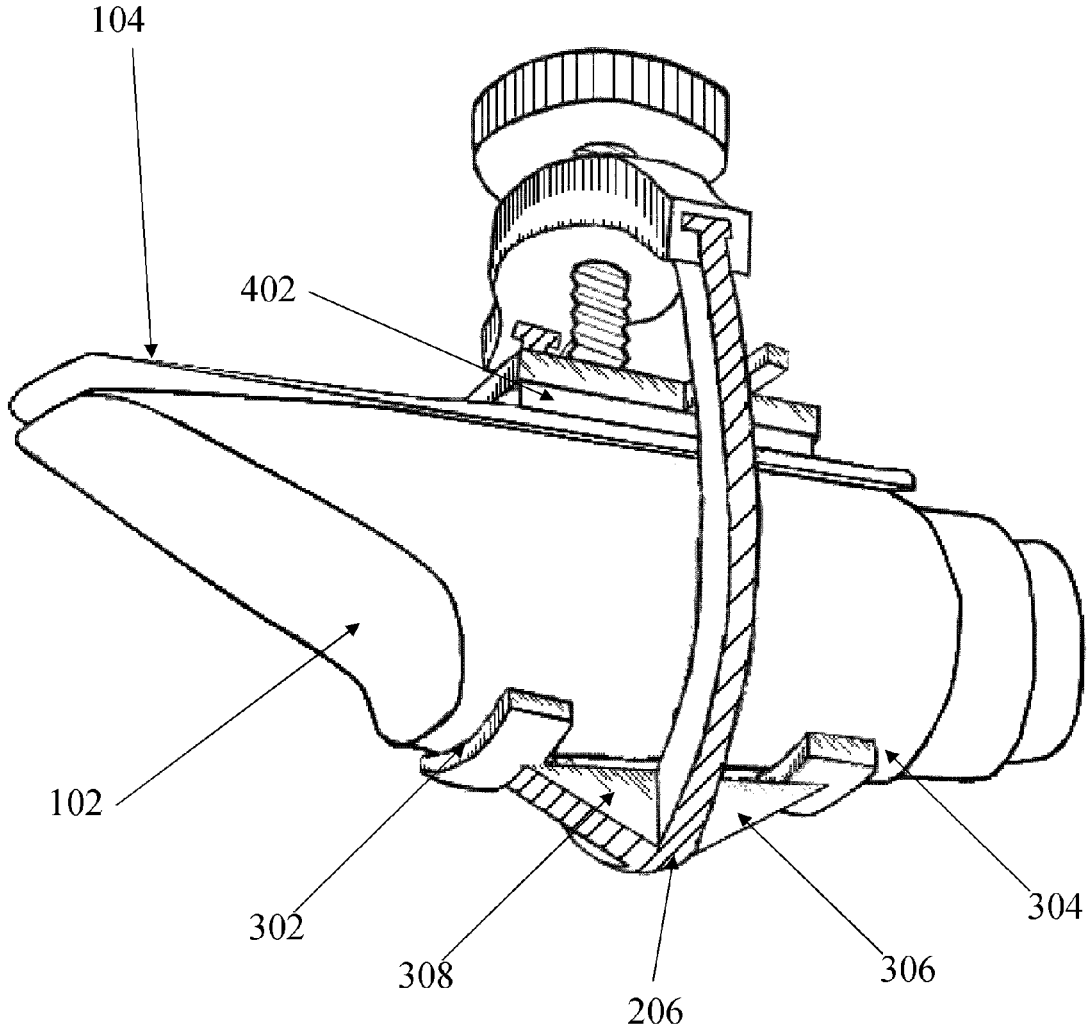
FIGS. 4A and 4B show illustrations of an exemplary embodiment of the invention installed on a mouthpiece and holding a reed.
Figure 4B:
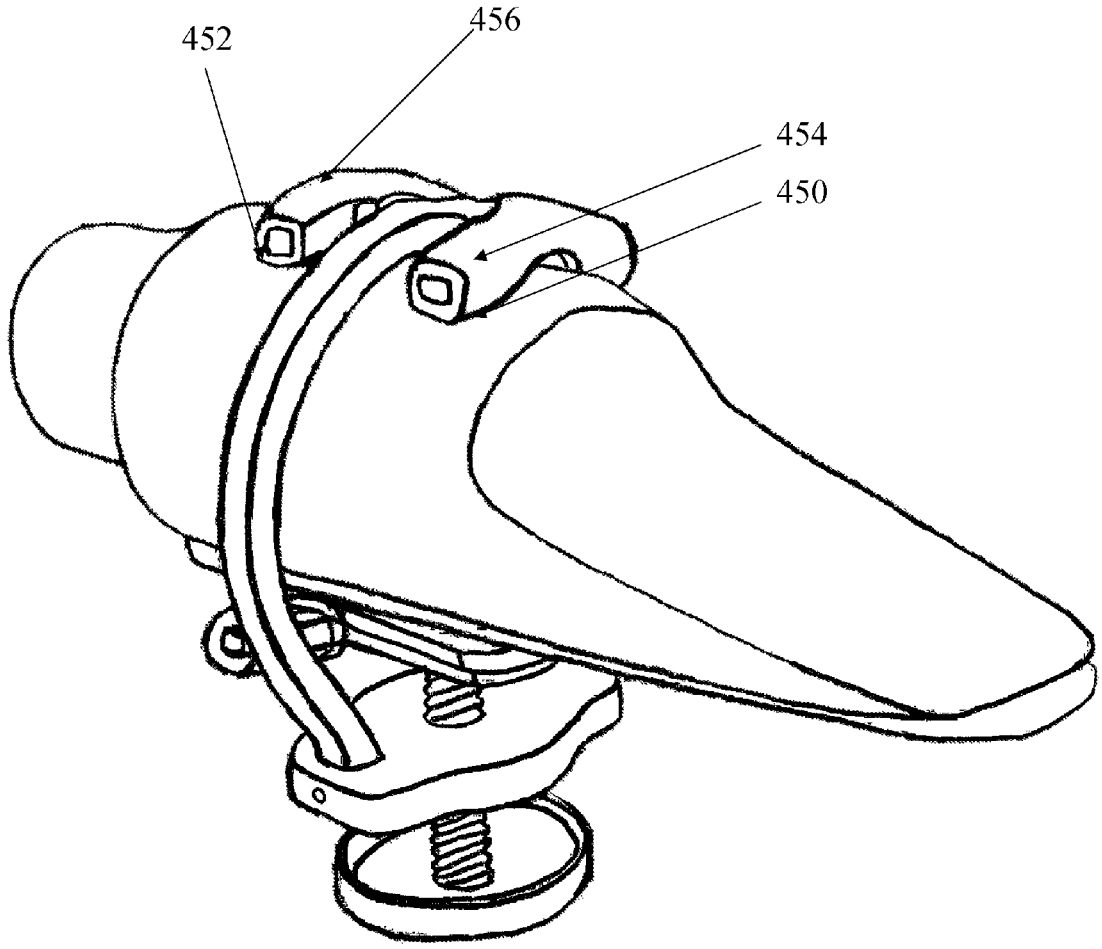
Figure 5:
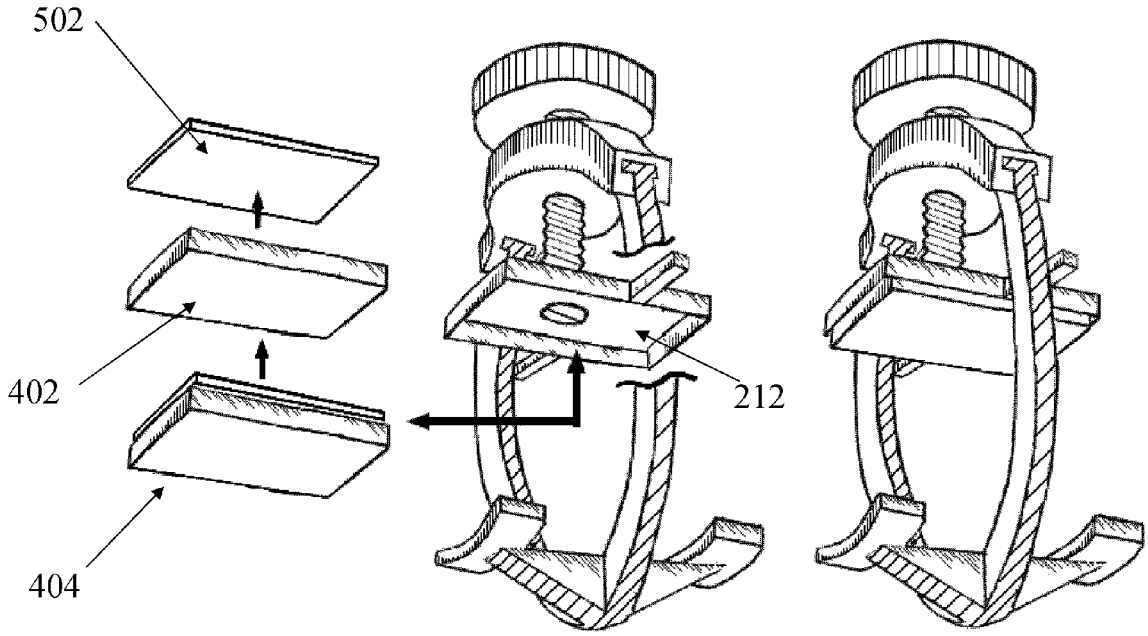
FIGS. 5, 6, 7, 8 and 9 show illustrations of various exemplary embodiments of the compression bed, compression mechanism and other and reed pressure members.
Figure 6:
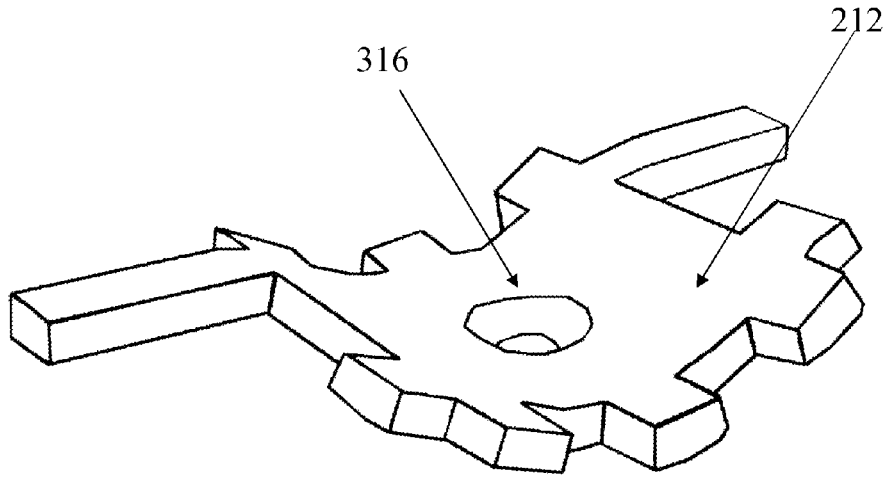
Figure 7:
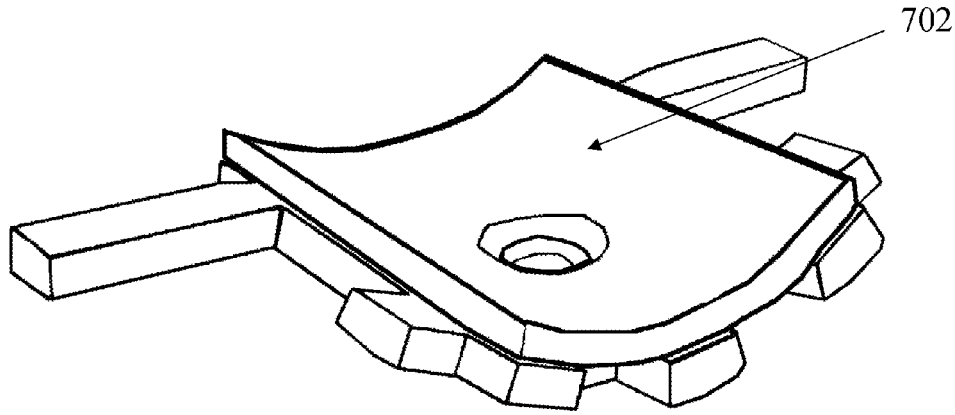
Figure 8:
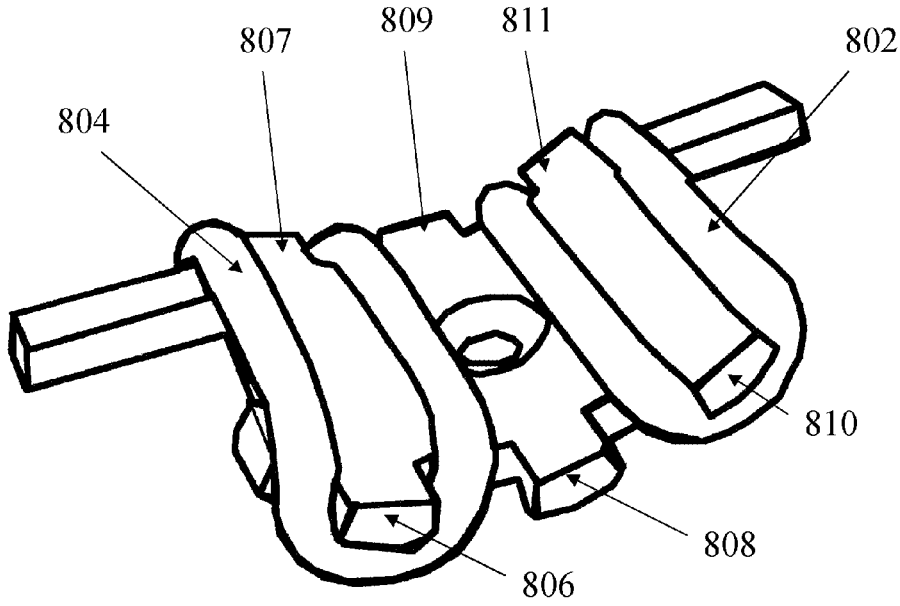

As seen on FIGS. 4A, 4B and 5 when mounted on a mouthpiece 102, the invention allows for a clean, solid, stable positioning of the reed 104 to said mouthpiece. Of course, the pressure exerted on the reed will be transmitted to the opposite side of the circumference formed by the bridge and body, to the other side of the mouthpiece circumference, in effect a point that is significantly the antipode of the pad. At this point, a spar 206 comes off the body 204 and connects through the wing elements (306, 308) to the wing support elements (302, 304).

These wing elements spawn from the spar 206, and provide stability by counteracting the force applied on the reed (and hence the mouthpiece) by the compression mechanism on the other side. Optimal performance is found when the areas contacted on the antipodes are significantly similar. In this fashion, it is also desired that the points of contact on the surface of the mouthpiece be significantly orthogonal to its surface.

This dual and antipodal contact with the mouthpiece may occur in a variety of optional ways. In one embodiment, this is done by allowing the two or more wing support elements 302, 304 that are made of the same material as the body 204, to directly contact the mouthpiece.

FIG. 5 provides an exemplary illustration of the reed pushing portion of the invention. In one embodiment, the pad 212 is embodied with magnetic properties. In one embodiment this is done by making it of a magnetic or ferrous material (such as steel), in order to induce into it a magnetic property that'll "hold" the dampening material assembly 404, itself made of a composite sandwich that includes a suitable dampening material 402, and a magnet 502. In an alternate embodiment, the bed is made of any material (including non-ferrous materials), and a flexible adhesive magnet is attached to both the bed and the dampening material sandwich, allowing them to adhere to each other magnetically. The list of suitable dampening materials is comprised of such materials as cork, leather, silicone, rubber, fleece, cotton and others such vibration insulation materials. In an alternate embodiment, the attachment function performed by the magnetic surfaces may also be accomplished by glue, Velcro, tape, and others.

In an alternate embodiment, a vibration dampening material such as cork, plastic, tape, cellulose or such other may be placed on the compression pad 212 to further reduce any vibration communicated from the reed as the musician creates music. In an alternate embodiment, the wing support elements are coated, sandwich or surrounded by an isolating material (454, 456) which in turns makes contact (450, 452) with the mouthpiece. As with the material in the pad 212, this isolating material may be rubber, cork, tape, plastic, silicon or any other suitable dampening material. This reduction in vibration, friction and/or reverberation allows for a cleaner sound production by the reed, as well as providing a good grip support in helping to maintain the reed in place with regards to the mouthpiece.

As seen in FIGS. 6, 7, 8 and 9, in one embodiment, the isolating material may be placed as a relatively continuous horizontal surface 702 making contact with all or large portions of the reed. In an alternate embodiment, the isolating material is comprised of one or more loops (802, 804) of material placed along the hooks or protrusions (806, 807, 808, 809, 810, 811) built into the pad 212.

Figure 10:
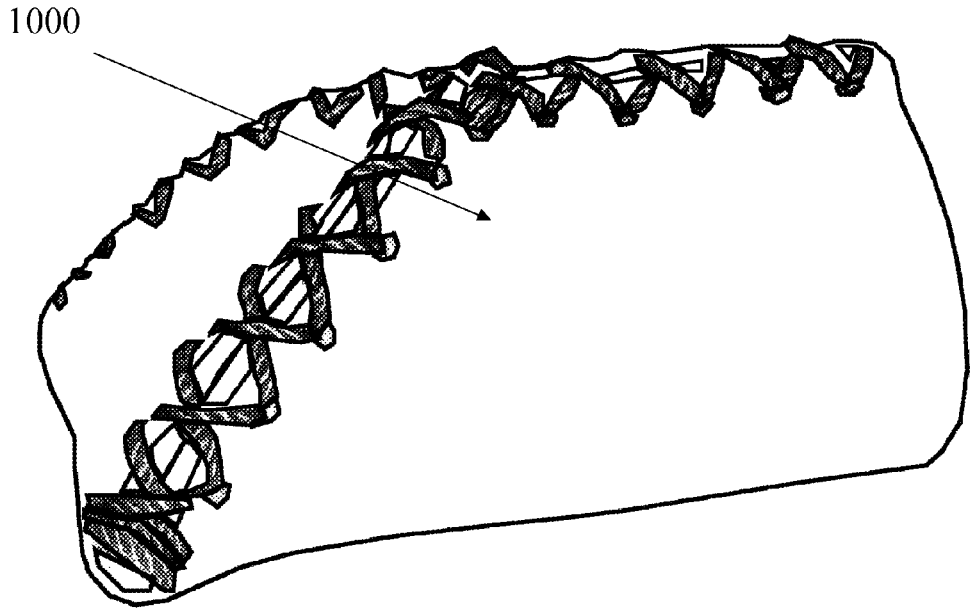
FIG. 10 shows an illustration of an exemplary embodiment of the system cover.

Finally, suitable protection FIG. 10 of the unit when placed in the mouthpiece is accomplished by the addition of a pouch 1000. Said pouch may be may manufactured from any number of materials, including leather, plastic and others.

CONCLUSION

In concluding the detailed description, it should be noted that it would be obvious to those skilled in the art that many variations and modifications can be made to the preferred embodiment without substantially departing from the principles of the present invention. Also, such variations and modifications are intended to be included herein within the scope of the present invention as set forth in the appended claims. Further, in the claims hereafter, the structures, materials, acts and equivalents of all means or step-plus function elements are intended to include any structure, materials or acts for performing their cited functions.

It should be emphasized that the above-described embodiments of the present invention, particularly any "preferred embodiments" are merely possible examples of the implementations, merely set forth for a clear understanding of the principles of the invention. Any variations and modifications may be made to the above-described embodiments of the invention without departing substantially from the spirit of the principles of the invention. All such modifications and variations are intended to be included herein within the scope of the disclosure and present invention and protected by the following claims.

The present invention has been described in sufficient detail with a certain degree of particularity. The utilities thereof are appreciated by those skilled in the art. It is understood to those skilled in the art that the present disclosure of embodiments has been made by way of examples only and that numerous changes in the arrangement and combination of parts may be resorted without departing from the spirit and scope of the invention as claimed. Accordingly, the scope of the present invention is defined by the appended claims rather than the forgoing description of embodiments.

I claim:

1. A ligature for selectively attaching a reed to a mouthpiece of a wind instrument, said ligature comprising;

a circumferential assembly formed by a flexible attachment of a bridge to both ends of a body;

a compression pad, designed to press said reed against said mouthpiece;

a mechanism for applying pressure on said compression pad wherein said mechanism for applying pressure on the compression pad includes a compression means comprised of a screw travelling through a threaded opening on said bridge;

a spar with wing elements located significantly diametrically opposite said compression pad, said wing elements designed to make contact with the mouthpiece, and having an area significantly similar to that of the compression pad;

dampening means at contact points with both the reed and the mouthpiece of the ligature, wherein said dampening means are selected from a group comprised of plastic, cork, leather, synthetic leather, silicone, rubber, fleece, cotton or vinyl; and said compression means are magnetically attached to the compression pad.

* * * * *